US006644566B1

(12) United States Patent
Garrish et al.

(10) Patent No.: US 6,644,566 B1
(45) Date of Patent: Nov. 11, 2003

(54) WATER DISTRIBUTION CONDUIT

(75) Inventors: Bryan F. Garrish, Ellicott City, MD (US); Thomas P. Carter, Olney, MD (US)

(73) Assignee: Baltimore Aircoil Company, Inc., Jessup, MD (US)

( * ) Notice: Subject to any disclaimer, the term of this patent is extended or adjusted under 35 U.S.C. 154(b) by 0 days.

(21) Appl. No.: 09/667,029

(22) Filed: Sep. 21, 2000

(51) Int. Cl.[7] ..... B05B 1/14; B05B 15/00; A62C 2/08; A62C 37/08

(52) U.S. Cl. ..... 239/550; 239/548; 239/557; 239/565; 239/450

(58) Field of Search ..... 239/450, 436, 239/548, 550, 556, 557, 565; 261/115

(56) References Cited

U.S. PATENT DOCUMENTS 1,520,125 A * 12/1924 Haas ..... 239/518
2,507,604 A * 5/1950 Lawson ..... 165/115
3,198,441 A * 8/1965 Facius ..... 222/567
3,807,145 A * 4/1974 Engalitcheff et al. ..... 239/550
4,058,262 A * 11/1977 Burnham ..... 239/545
4,208,359 A * 6/1980 Bugler et al. ..... 239/222.11
4,361,426 A * 11/1982 Carter et al. ..... 261/112.2
4,390,478 A * 6/1983 Sheperd ..... 239/500
4,557,877 A * 12/1985 Hofstetter ..... 239/450
4,592,878 A * 6/1986 Scrivnor ..... 137/625.32
5,180,528 A * 1/1993 Kaplan ..... 261/111
5,431,858 A * 7/1995 Harrison, Jr. ..... 261/111

* cited by examiner

*Primary Examiner*—Michael Mar
*Assistant Examiner*—Darren Gorman
(74) *Attorney, Agent, or Firm*—Edward J. Brosius

(57) ABSTRACT

A distribution apparatus for a cooling tower has a source of liquid communicated to a plurality of branches extending from the source of liquid for transfer of a liquid to a cooling tower arrangement, where the branches are provided with a plurality of generally laterally extending protuberances providing a calming region from a generally turbulent liquid flow to produce a relatively quiescent region above a port and nozzle for stable fluid flow to a nozzle and a better controlled flow to the tower media.

1 Claim, 7 Drawing Sheets

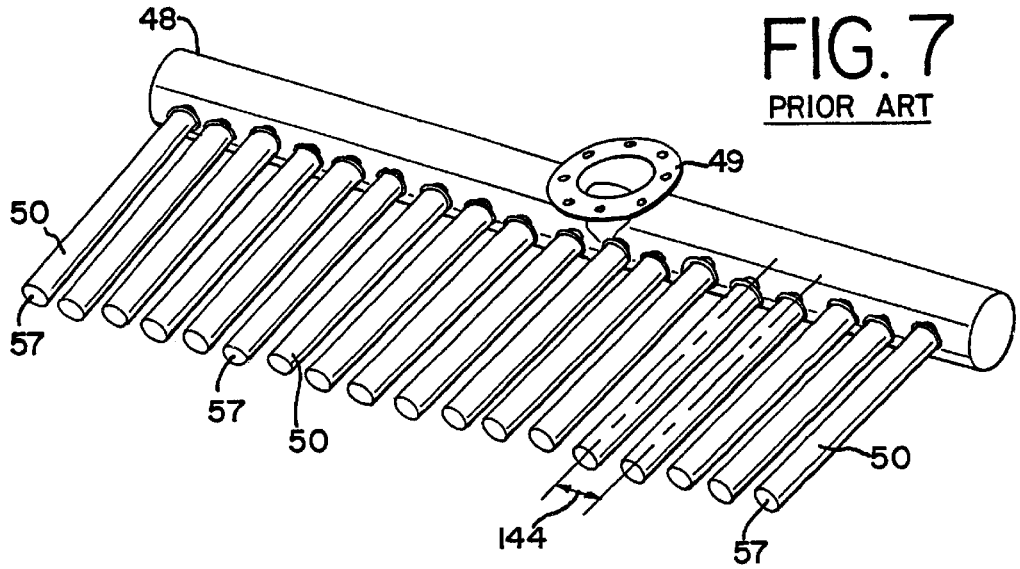
FIG. 7
PRIOR ART
FIG.8
PRIOR ART
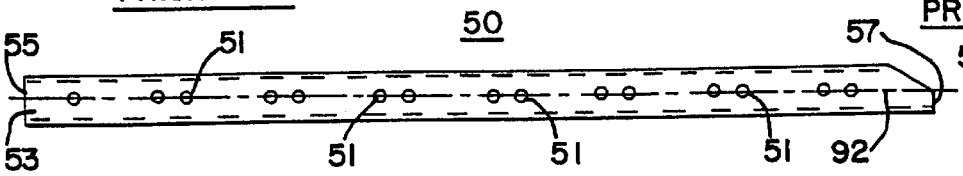
FIG.9
PRIOR ART
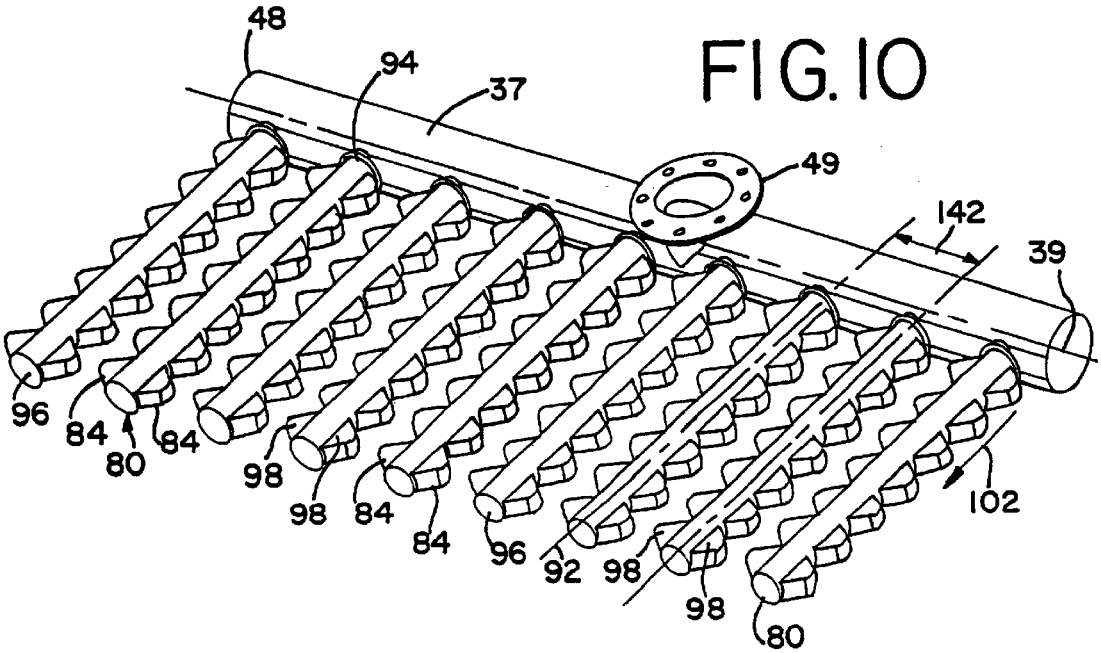
FIG.10

WATER DISTRIBUTION CONDUIT

FIELD OF THE INVENTION

The present invention provides a fluid distribution conduit. More specifically, a conduit apparatus incorporating multiple nozzle ports and individual calming regions for each port is provided for a cooling tower.

BACKGROUND OF THE INVENTION

Evaporative cooling equipment such as cooling towers, evaporative condensers, and closed circuit fluid cooling towers have been used for many years to reject heat to the atmosphere. Cooling towers typically operate by distributing the water to be cooled over the top of a heat transfer surface and passing the water through the heat transfer section while contacting the water with air. As a result of this contact, a portion of the water is evaporated into the air thereby cooling the remaining water.

In closed-circuit cooling towers and evaporative condensers, the fluid to be cooled, or the refrigerant to be condensed, is contained within a plurality of closed conduits. Cooling is accomplished by distributing cooling water over the outside of the conduits while at the same time contacting the cooling water with air.

In all applications of evaporative cooling equipment, proper water distribution within the equipment is critical to efficient performance of the equipment. Uneven distribution of water to the heat transfer surface will reduce the available air-to-water interfacial surface area, which is necessary for heat transfer. Severe misdistribution of water may result in air flow being blocked through those areas of the heat transfer media which are flooded with water while at the same time causing air to bypass those areas of the media which are starved of water.

Generally, water distribution systems used in evaporative cooling equipment are either of the gravity-feed type or the pressure-spray type. Gravity-feed distribution systems typically comprise a basin or pan which is positioned above the heat transfer media. In the bottom of the basin are positioned nozzles which operate to gravitationally pass water contained in the basin through the bottom of the basin while breaking up the water into smaller droplets and distributing the water droplets to the underlying heat transfer surface.

Pressure-spray distribution systems, typically comprise multiple water distribution ranches, or headers, positioned above the heat transfer media with each branch containing a multitude of small spray nozzles. Generally, these nozzles are arranged closely in a uniform spacing in an attempt to achieve even water distribution across the typically rectangular top of the heat transfer surface.

U.S. Pat. No. 5,431,858 to Harrison, Jr. discloses a fluid distribution system for continuously distributing hot fluid evenly across the top face of a fill assembly in a cross-flow water cooling tower. This disclosure provided a uniform fluid head to the distribution pan and provides an in-line basket filter to prevent clogging of the metering nozzles in the pan. Further, this apparatus was arranged to conserve the total energy of the flowing water, especially the velocity component, and to advantageously utilize that energy.

It is also desired to keep the overall height of the cooling equipment to a minimum, which necessitates positioning the spray distribution system at a minimum distance above the top of the heat transfer surface. The closer the distribution system is to the top of the heat transfer surface, the less room there is for the water to be distributed and the less surface area the spray from each nozzle is generally able to cover.

In the present environmentally conscious era, conservation of energy is of critical importance to minimize the required spray water pumping pressure. Typically, pressure spray distribution systems have operated at spray pressures in the range of 3 to 8 psig. However, it is now desired to operate with spray pressures of no greater than 3 psig. This is especially true in very large towers where a very small increase in spray pressure requirements can increase unit operating costs by hundreds of thousands of dollars over the lifetime of a unit. Achieving uniform water distribution at low spray pressures is very difficult. This is due to the fact that at low spray pressures, there is very little energy available from the spray pressure to assist in spreading and distributing the water flow through the spray nozzles.

A potential method to distribute water in a large cooling tower would be to simply increase the size of the components of the distribution systems which have been successfully used on smaller cooling towers. However, as a practical matter this is not feasible as an increase in the distribution system size requires an increase in all dimensions of the distribution system by a proportional amount, including an increase in tower height. U.S. Pat. No. 4,208,359 to Bugler, III et al. describes a low pressure head, non-clogging water distribution system for large cooling towers. The nozzle emits a hollow cone of water which impacts a circular deflecting structure for production of a full cone of water.

Another problem to be accommodated in the pressure-spray type distribution systems is the avoidance of high fluid-velocity of effects of the water flow past the nozzles, which can induce a shearing effect. This shearing inhibits adequate liquid feed to the individual nozzles in the water distribution branch and uneven water flow to the top surface of the media or the top area of the heat transfer surface.

SUMMARY OF THE INVENTION

The present invention provides distribution branches for a pressure-spray type liquid distribution system. The distribution branches can accommodate substantially all of the nozzles presently provided on closely aligned branches extending from a common spray header, but the number of branches can be significantly reduced. The distribution branch of the present invention allows, or will tolerate, the high fluid velocities of present liquid distribution systems, but it will avoid the shearing effect above individual nozzles and provide a calming or stilling region above the nozzle for generally non turbulent liquid flow to individual nozzles. In an alternative embodiment, the individual branches can be provided with nozzles in about their present locations as well as providing the protuberances with the calming regions open to the fluid channel of the branch but displaced from the direction of fluid flow along this fluid channel. Reduction of the number of fluid carrying branches is a more ready access for servicing the area below the branches and above the heat transfer surface.

BRIEF DESCRIPTION OF THE DRAWING

In the Figures of the Drawing, like reference numerals identify like components, and in the Drawing:

FIG. 7 illustrates a conventional spray system with a header and spray branches;

FIG. 8 is a bottom view of a conventional spray branch in FIG. 7;

FIG. 9 is an end view of the conventional spray branch in FIG. 8;

FIG. 10 is an exemplary illustration of a header and spray branch assembly of the present invention;

DETAILED DESCRIPTION

Figure 1:
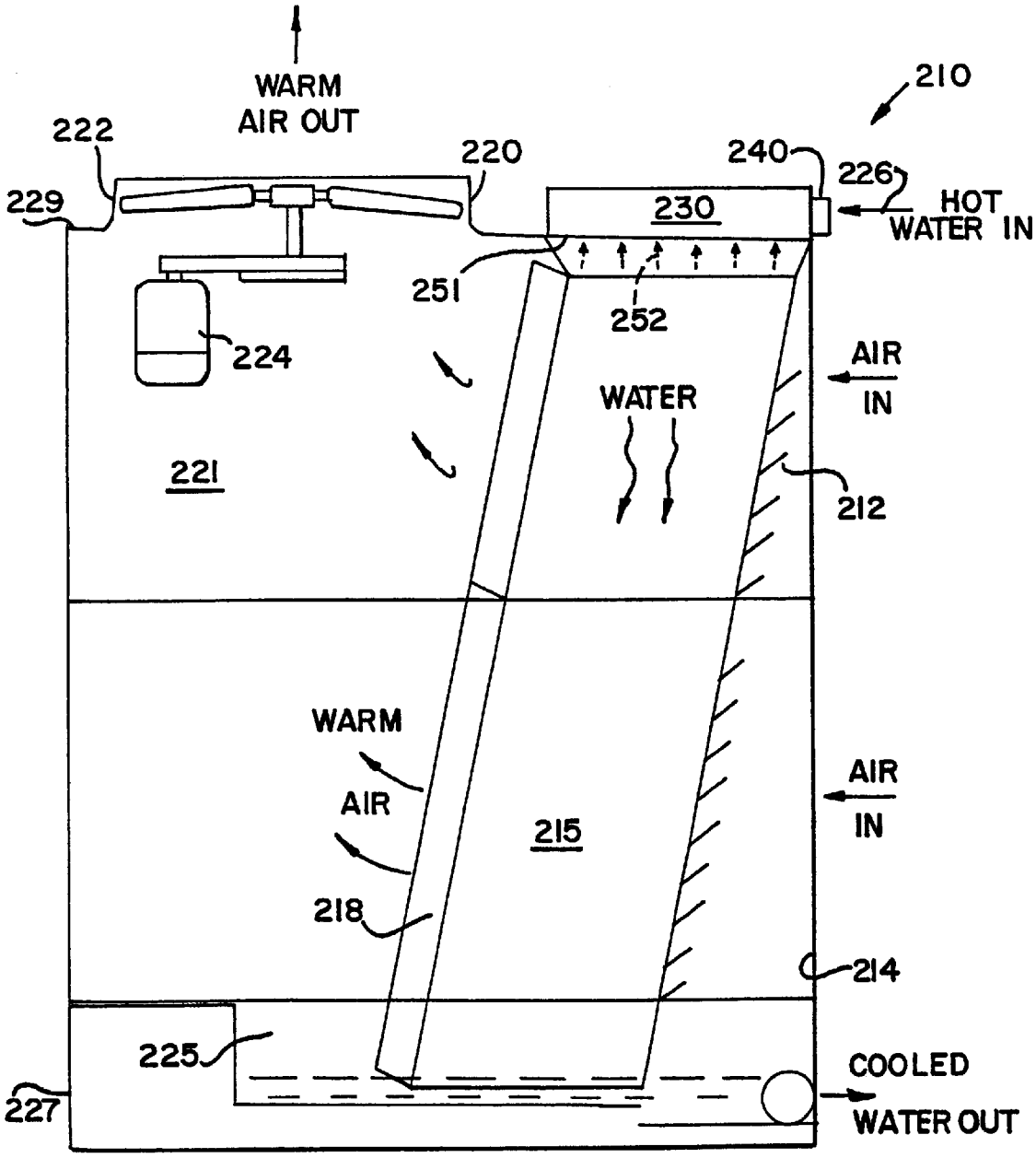
FIG. 1 is a side view in cross-section illustrating the air and water systems of a single-sided, air-inlet crossflow cooling tower with a water distribution box.
Figure 2:
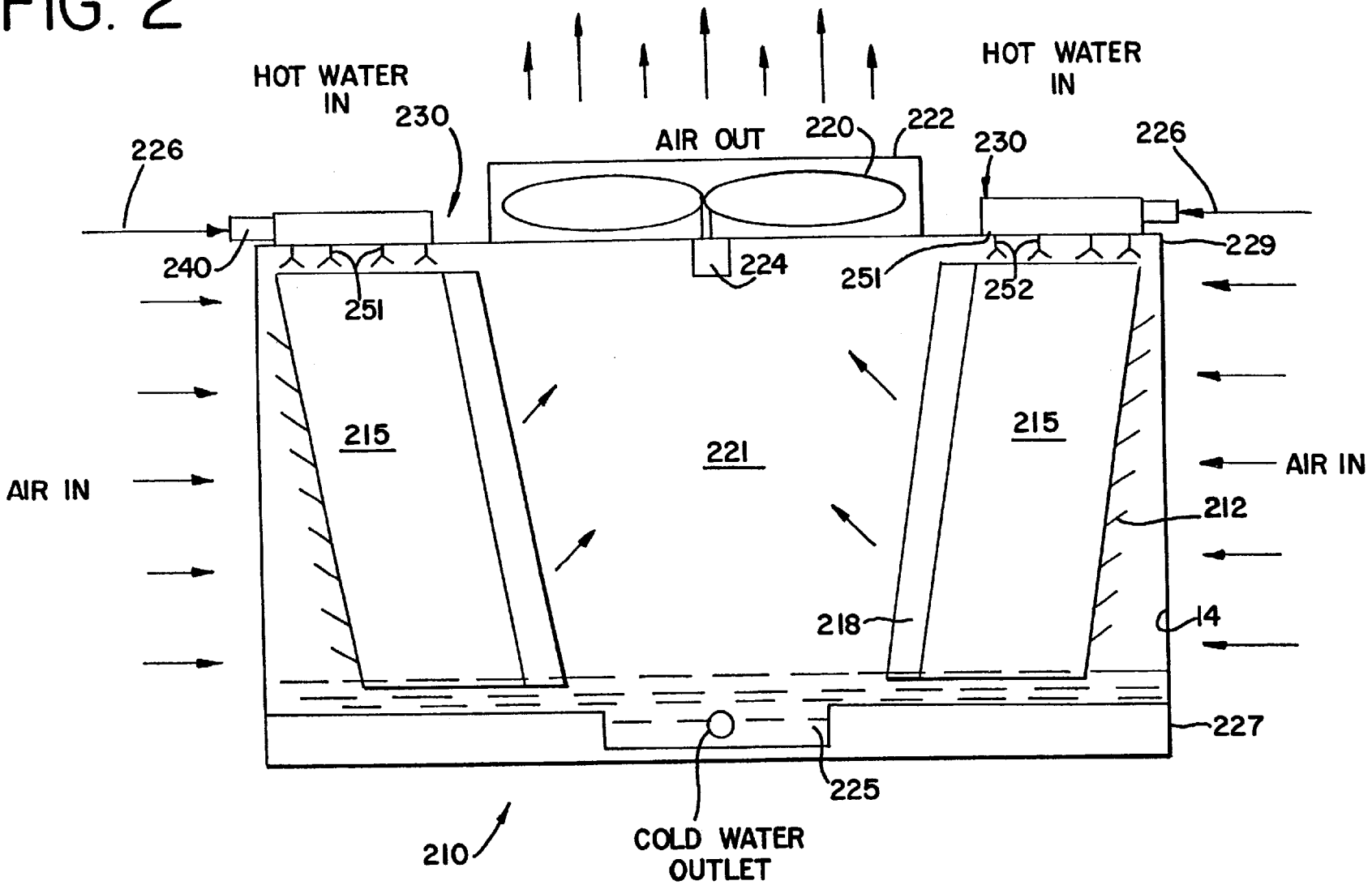
FIG. 2 is a side view in cross-section showing the air and water flow systems of a double-sided, air-inlet crossflow cooling tower.

The present invention provides liquid spray branches for a spray system of a cooling tower, which is illustrated in FIG. 1 by crossflow cooling tower 210. In this figure, cooling tower 210 is a single-sided air-inlet arrangement. The heat exchange apparatus has individual and controllable water and air inputs. Tower or apparatus 210 includes a foundation supporting a cold water collection reservoir or sump 225 at base 227 of a single bank of heat exchange fill media 215. FIG. 2 illustrates a double-sided, air-inlet heat exchange apparatus.

Apparatus 210 has frame or enclosure 214 supporting fill media 215. Fill front has an inlet air area 212 and the back of the fill media has air outlet 218. Crossflowing air is drawn through fill media 215 to exchange heat with hot water by evaporation, which relatively hot water is distributed across the top of fill media 215 and descends down each respective bank of media 215. Air is drawn through inlet 212 toward internal chamber 221 by fan 220 for upward discharge from tower 210 through fan shroud 222. Fan 220 in this illustration is driven by motor 224, which fan 220 is shown as a propeller type fan, but it could also be an induced or forced draft centrifugal fan. Further, it is possible to draw air through tower 210 by a natural draft.

The relatively hot water noted above is supplied to one bank of fill media 215 in FIG. 1 and two banks of fill media 215 in FIG. 2 by a dedicated inlet supply pipe 226 shown as an arrow in proximity to pipe throat or stub 240, which supply is typically adjacent to and outside enclosure 214. Pipe 226 vertically extends to top 229 of tower 210 to feed hot water from a heat exchange apparatus (not shown) coupled to cold water sump 225. In a typical application, cold water is withdrawn from sump 225 for communication to an external heat exchange apparatus, such as an air conditioning unit. In the illustrations of FIGS. 1 and 2, distribution pan 230 may be considered as a manifold for distribution of fluid to nozzles 252 at pan bottom 251. The specific type of heat exchange apparatus coupled to tower 210, such as an air conditioning unit, is not a limitation to the present invention and is only an exemplary structure.

Figure 3:
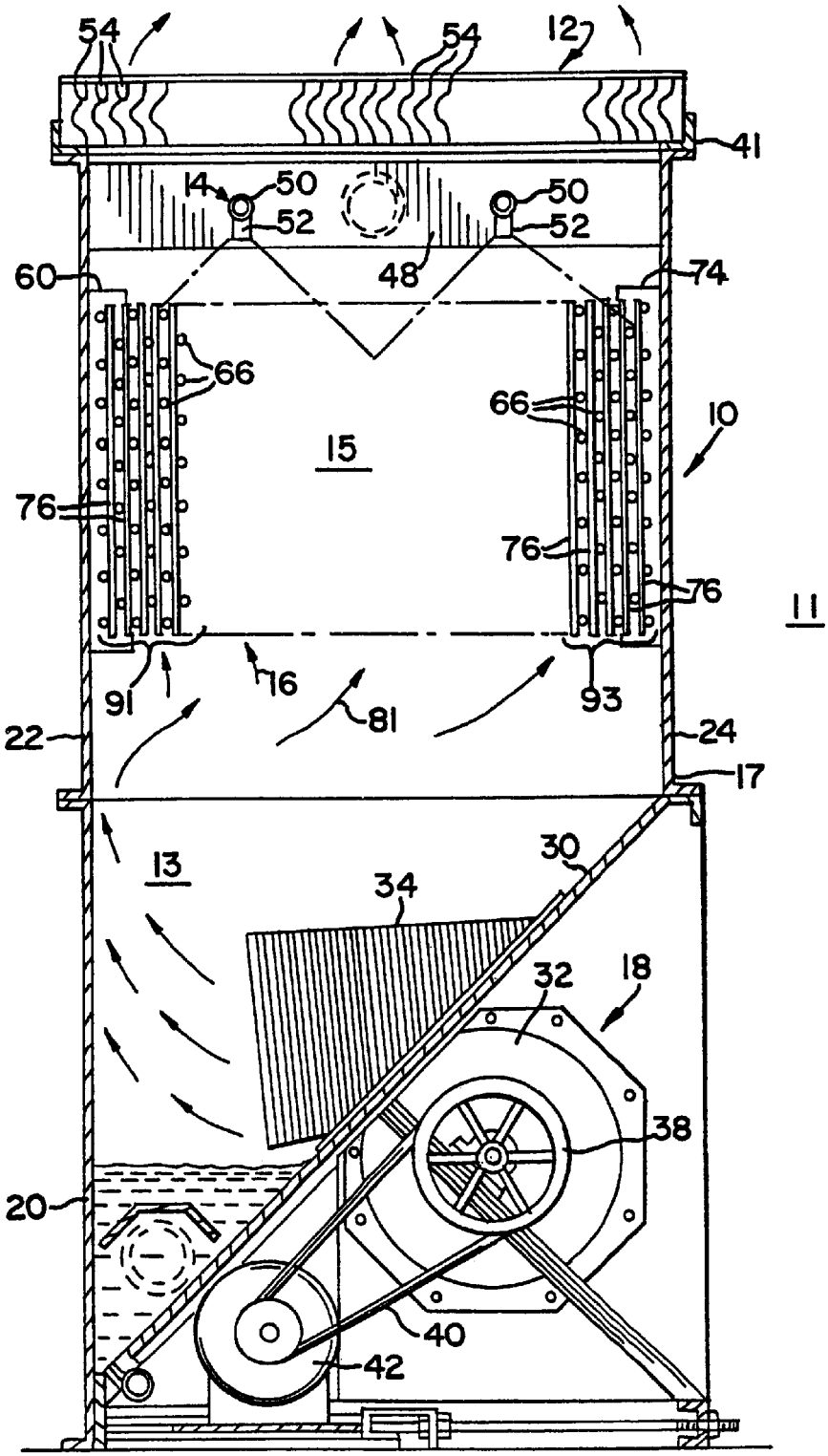
FIG.3 PRIOR ART
FIG. 3 is a side elevational view, partially in section of a prior art counterflow closed-circuit evaporative type liquid-gas heat exchanger.
Figure 4:
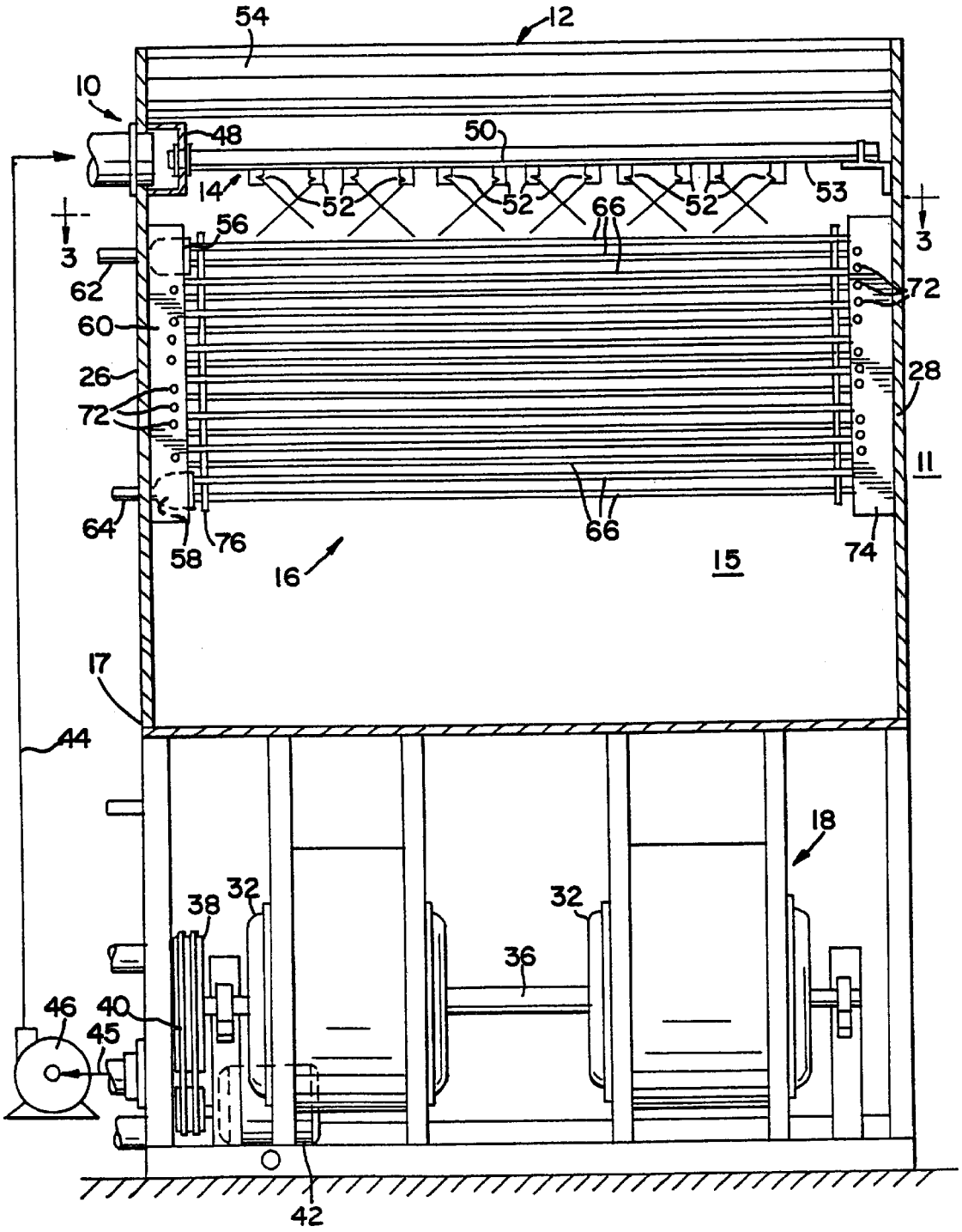
FIG. 4 PRIOR ART
FIG. 4 is a front elevational view, partially broken away and partially in section of the heat exchanger in FIG. 3.

In an alternative arrangement noted in FIG. 3, a liquid distribution system above coil assembly 16, which is functionally similar to fill media 215 of FIGS. 1 and 2, may encompass a pressurized fluid-flow system. It is recognized that the arrangements of FIGS. 1 and 2 have some similar operating components to the below-noted arrangement of FIGS. 3 to 6, but the alternatives will be discussed independently. Heat exchanger 11 of FIGS. 3 and 4 is illustrative of a typical cooling tower counterflow structure, but is not a limitation to the present invention. Heat exchanger 11 has a generally vertical casing 10 with different levels within its interior, including mist eliminator 12, water spray assembly 14, coil assembly 16, fan assembly 18 and lower water trough or sump 20. In a pressurized system, manifold 48 at tower top 41 may be coupled to a hot water inlet pipe 226 at flange 49 to receive the hot liquid. A plurality of branches or tubes 50 is connected to manifold 48 for receipt and transfer of hot liquid through nozzles 52 on the tube bottom edge. Tubes 50 are shown as equal length and parallel in this example and extend over coil assembly 16, or fill media 215 in FIGS. 1 and 2, at tower top 41 in FIGS. 3 and 4.

Casing 10 has vertical front wall 24 and rear wall 22 in FIG. 3 with side walls 28 and 28 noted in FIG. 4. Diagonal wall 30 downwardly extends from front wall 24 to rear wall 22 to provide sump 20. Fan assembly 18 is positioned behind and below diagonal wall 30. The illustrated fan assembly 18 has a pair of centrifugal fans 32 with outlet cowls 34 projecting through wall 30 into conduit 13 above sump 20 but below coil assembly 16. Fan assembly 18 includes drive motor 42 and pulley 38 on common drive shaft 36, which pulley 38 and motor 42 are coupled by belt 40.

Recirculation line 45 in FIG. 4 extends through side wall 26 of housing 10 near the base of sump 20. Line 45 extends from sump 20 to recirculation pump 46, line 44 and subsequently to water spray assembly 14 for communication of fluid for spraying over coil assembly 16.

Water spray assembly has water box or manifold 48 extending along side wall 26 and a pair of distribution pipes 50 extending horizontally across the interior of housing 10 to opposite wall 28. Pipes 50 are fitted with a plurality of nozzles 52, which emit intersecting fan-shaped water sprays to provide an even distribution of water over coil assembly 16. Pipes 50 in this illustration act as a branch or elongate member with a plurality of nozzles 52 as shown in FIG. 4. The specific type or style of water spray assembly 14 and nozzle 52, or 252 in FIGS. 1 and 2, is merely exemplary and not a limitation to the present invention.

Mist eliminator 12 in FIGS. 3 to 6 has a plurality of closely spaced elongated strips 54, which are bent along their length to form sinuous paths from the region of water spray assembly 14 through top 41 of housing 10. Mist eliminator 12 extends across substantially the entire cross-section of housing 10 at top 41.

Figure 5:
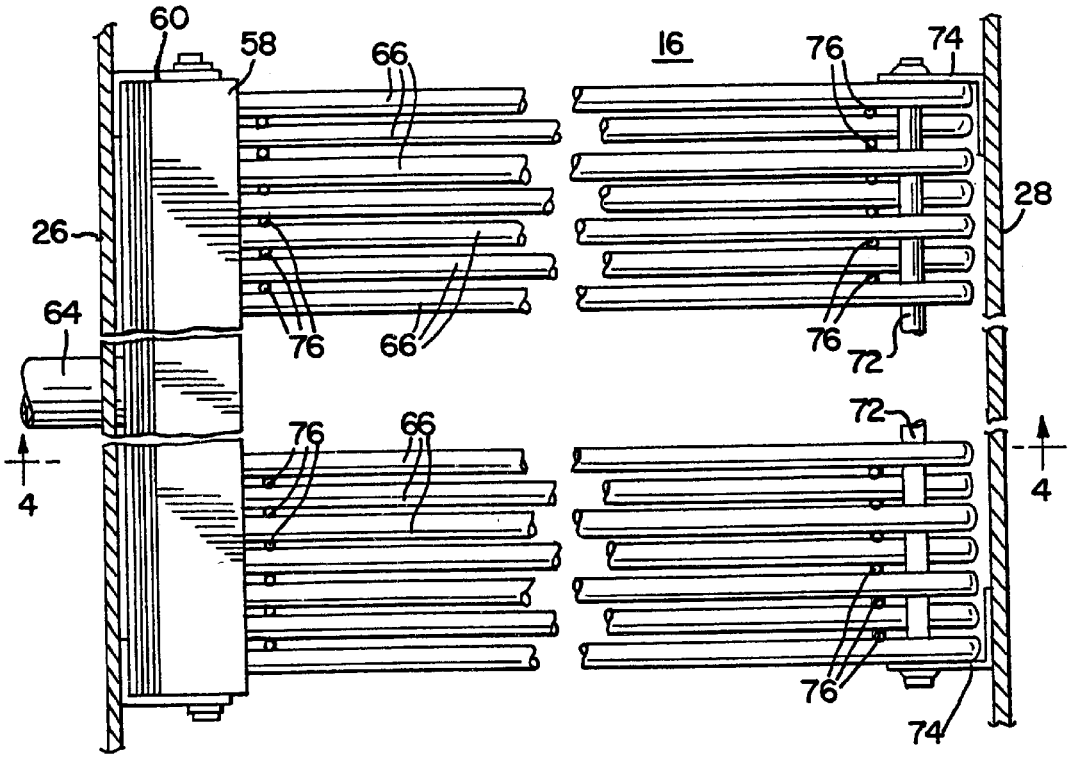
FIG.5 PRIOR ART
FIG. 5 is a coil assembly in FIG. 4 taken along line 3—3.
Figure 6:
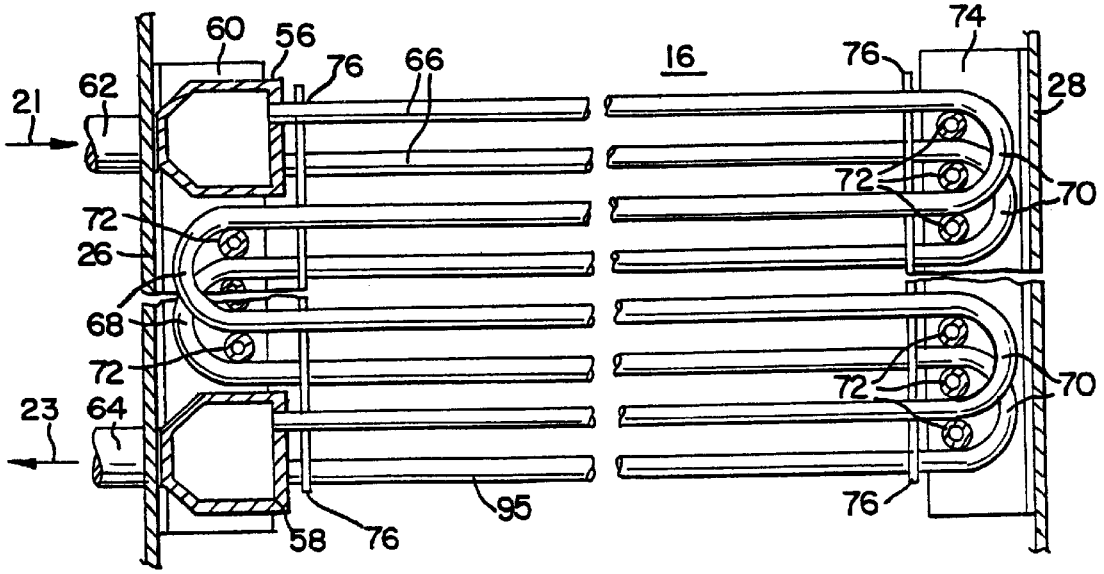
FIG.6 PRIOR ART
FIG. 6 is the coil assembly in FIG. 5 taken along line 4—4.

Coil assembly 16 in FIGS. 3 and 4 is noted with upper inlet manifold 56 and lower outlet manifold 58, which manifolds 56 and 58 extend horizontally across the upper interior conduit 15 adjacent side wall 26, as noted in FIGS. 4 to 6. In FIG. 5, manifolds 56 and 58 are secured in position by brackets 60 on side wall 26. Fluid inlet fluid conduit or port 62 and outlet conduit or port 64 extend through sidewall 26 and are connected with upper manifold 56 and lower manifold 58, respectively. These fluid ports may be connected to receive a fluid to be cooled or condensed, for example the refrigerant from a compressor in an air conditioning system (not shown).

Coil assembly 16 has a plurality of cooling tubes or circuits 66 connected between upper manifold 56 and lower manifold 58 in FIGS. 4 to 6. Each tube 66 is formed into a serpentine arrangement through 180° bends 68 and 70 in FIG. 6 near side walls 26 and 28. Thus, different segments of each tube 66 extend generally horizontally across the interior conduit 15 of housing 10 between side walls 26 and 28 at different levels in interior 15 along parallel vertical planes closely spaced to the plane of each of the other tubes 66. In addition, tubes 66 are arranged in alternately offset arrays with each tube being located a short distance lower or higher than the tubes or tube segments on each side of it. Further, horizontally extending support rods 72 are mounted at wall 26 between 60 and at wall 28 between brackets 74, which rods support tubes 66 at bends 68 and 70. Vertical spacer rods 76 extend between adjacent tubes 66 near support rods 72 to maintain a separation between adjacent tubes in the lateral direction.

In FIGS. 4 and 6, the vertical connection of tubes 66 with upper manifold 56 and lower manifold 58 is illustrated. Also in FIG. 6, the inlet fluid to be cooled is noted by arrow 21 at inlet port 62 and discharge of the cooled fluid is noted at discharge port 64, which is demonstrative of the almost universal practice of providing the inlet fluid at the top of interior chamber 15 and discharging the fluid at the lower section of chamber 15.

In operation of heat exchanger 11, fluid-to-be-cooled or condensed, such as a refrigerant from an air conditioning system, flows into heat exchanger 11 through inlet conduit 62. This fluid is then distributed by upper manifold 56 to the upper ends of tubes 66 and it flows down through serpentine tubes 66 to lower manifold 68 for discharge from outlet port 64. As the fluid-to-be-cooled flows through tubes 66, a liquid, such as water, is sprayed from nozzles 52 downward onto the outer surfaces of tubes 66 while air is simultaneously blown from fan 32 upward between tubes 66. The sprayed water is collected in sump 20 and this water is elevated to the tower top for recirculation to spray assembly 14. The upwardly flowing air passes through mist eliminator assembly 12 and exhausts from unit 12. Although fan 32 is noted at the lower portion of unit 11, it is known that such fans can be positioned at the tops of such units to pull air through the assembly, and the present assembly is merely exemplary and not a limitation.

As noted above water spray assembly 14, includes manifold or header 48, which receives fluid from pump 46 and line 44. This fluid is at an elevated pressure for communication to distribution pipe 50 and nozzles 52. In this arrangement of FIG. 4, the fluid flow through pipe 50 may be at an elevated velocity and nozzles 52 may not receive a uniform supply of fluid as a result of a shear effect. Although only a single pipe or branch 50 is noted in this illustration of FIG. 4, it is known that a plurality of such tubes or pipes 50 may be coupled to manifold 48 for liquid distribution.

An illustrative prior art arrangement of a manifold 48 having multiple branches 50 is noted in FIG. 7 in an enlarged view. In this FIG. 7 arrangement, manifold 48 is shown as a tubular or cylindrical section with flange 49 for connection to a feed line such as line 44. Openings or ports in manifold 48 can receive branches 50, which may be secured in manifold 48 by securing means such as mated threads, welding, brazing, glue, snap-fits or other means known in the art. The specific securing means is not a limitation to the present invention. In this prior art illustration, branches 50 are noted as cylinders with open end 55 and closed end 57, as shown in FIG. 8. Branches 50 may have ports 51 along bottom surface or edge 53 to receive nozzles 52, which ports 51 are noted along branch bottom edge 53 in FIGS. 8 and 9. This is a typical and illustrative example of many prior art header and nozzle arrangements, and it is considered that such branches 50 would be susceptible to the effects of high-velocity fluid flow including shearing.

Figure 11:
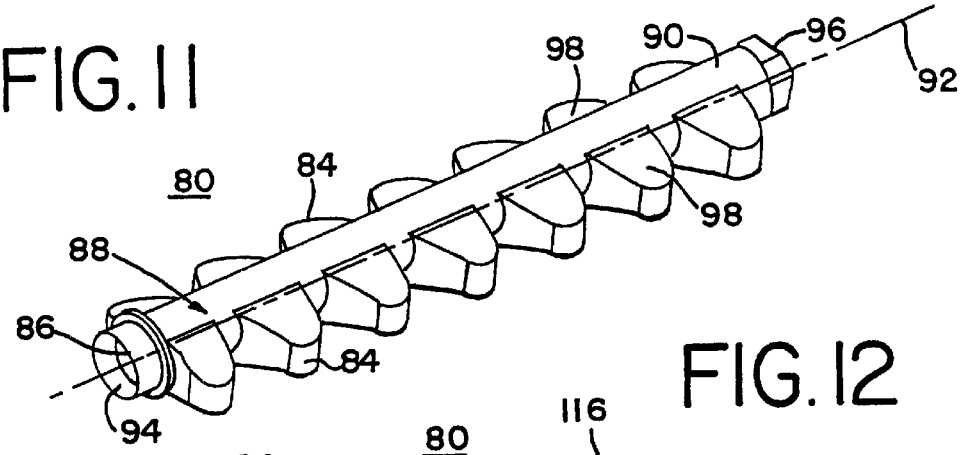
FIG. 11 is an oblique top view of an embodiment of the present invention.

The present invention provides a branch or liquid transfer pipe 80 to provide liquid transfer and quiet regions 82 within the protuberances 84 radially extending from pipe channel 86. A preferred embodiment of branch 80 is shown in FIG. 11 in an oblique view with cylindrical central portion 88 having side wall 90, central passage or channel 86, longitudinal axis 92, open end 94 and closed end 96. In this figure, protuberances 84 extend from side wall 90 on either side of central portion 88, and they are approximately in planar alignment across upper surfaces 98 and lower surfaces 100 in FIG. 12. This may be referred to as lateral or radial alignment from axis 92.

Figure 12:
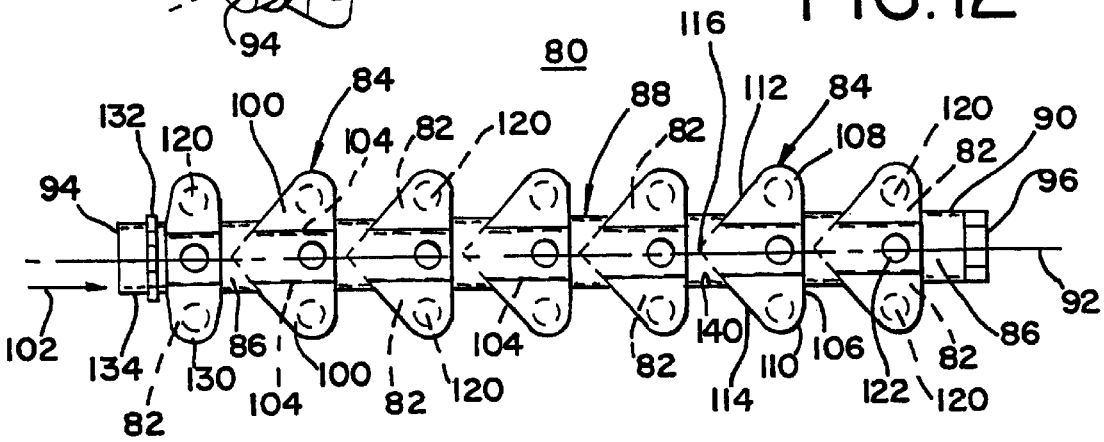
FIG. 12 is a bottom view of the embodiment of FIG. 11.

In FIG. 12, a bottom view of an embodiment of branch 80 is shown with protuberances 84 having a generally triangular outline, but the pronounced outline is at least partially due to the manufacturing technique for provision of the branch. Although there are a plurality of protuberances 84 noted in the figures, only one protuberance will be described and the description will be considered applicable to the several protuberances 84. In this embodiment, protuberance 84 have calming regions on either side of channel 86, which extends the length of cylinder 88. Regions 82 are open to channel 86 through passages 104 to receive liquid communicating through channel 86 as indicated by arrow 102. Protuberance 84 has back wall 106 with first end 108 and second end 110. First sloped wall 112 and second sloped wall 114 extend from first and second ends 108, 110, respectively, to intersect at point 116 about aligned with axis 92. This presents an approximately trapezoidal outline to calming region 82, although the basin shape is not a limitation to the present invention. However, back wall 106 provides a stop or inhibition to high-velocity fluid flow and the sloped walls 112 and 114 allow for energy dissipation of any rebounding fluid. This inhibition to the fluid flow stagnates the fluid velocity on the back wall of the asymmetric protuberance. Thus, the calming region 82 is available in protuberances 84 on either side of axis 92 in this embodiment.

Each calming region 82 has a port 120 for receipt of a nozzle, such as nozzles 52. In addition, in an alternative arrangement nozzle ports 122 may be provided along cylinder 88 for additional liquid flow, which is a design choice. These nozzles 52 in the flow channel 86 of cylinder 88 would still be exposed to the previously noted wall shear forces from the fluid flow velocity effects, but such added ports and nozzles 52 could be utilized to supplement fluid flow from manifold 48 and branches 50 when required. It is expected that such fluid flow in nozzles 52 of channel 86 would not be as great as the flow through protuberance calming regions 82.

In each of FIGS. 11 to 14, generally rectangular appearing protuberances 130 are noted in proximity to branch open ends 94. Protuberances 130 are similar to protuberances, 84, but they have been truncated to accommodate open-end collar 132 and neck 134, which may be necessary for mating with manifold 50. However, protuberances 130 function to provide calming regions 82 and ports 120 while utilizing all of the available length of branch side wall 90 along the length of cylinder 88. Collar 132 may be threaded to provide a screw thread for mating with a threaded opening in manifold 50 for securing branch 80.

Figure 13:
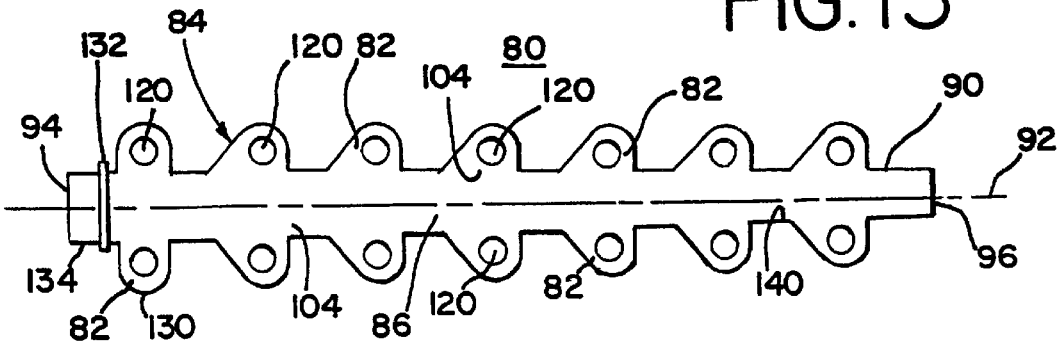
FIG. 13 illustrates an alternative liquid-spray branch of FIG. 10 which tapers from its open end to its closed end; and, FIG. 14 illustrates an alternative liquid-spray branch of FIG. 10 wherein the protuberances are arranged in a staggered alignment along the branch.

FIG. 13 illustrates branch 80 with side wall 90 tapering from open end 94 to closed end 96. In this embodiment, the outer ends 108 and 110 of protuberances 84 also taper inward to axis 92 from open end 94 to closed end 96. This figure illustrates an embodiment where nozzle ports 120 are only provided to each calming region 82 but not along cylinder side wall 90.

Figure 14:
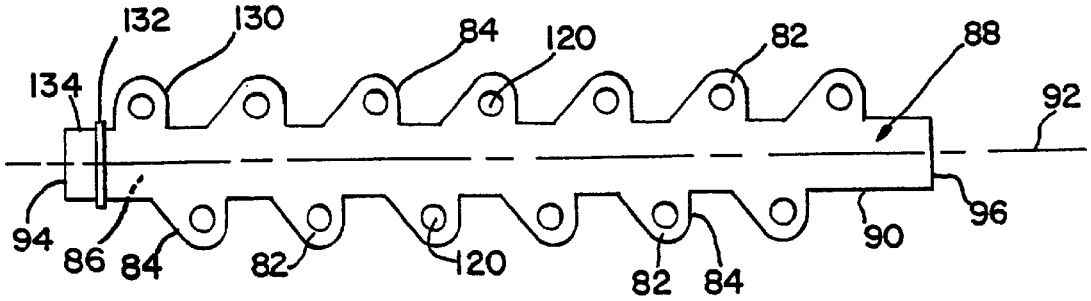

FIG. 14 shows a staggered array of protuberances 84 along cylinder 88. More particularly cylinder 88 has internal wall 140 providing passage 86. In this view, each individual protuberance 84 has its opening 104 to passage 86 facing an internal portion of side wall 140. It is felt that some applications may find that the overall staggered pattern may produce a more preferable arrangement to generate a more uniform spray pattern through this staggered configuration.

In FIG. 10, a representative assembly of branches 80, as noted in FIG. 11, is coupled to a manifold 48. In this FIG. 10, the multiple branches 80 project from a manifold side wall 37 and along and normal to an axis 39. Branches 80 are generally arranged in a parallel relationship with upper surfaces 98 approximately parallel. It is noted that the nozzles in ports 120 would project from lower surfaces 100, which nozzles and ports are not shown in this view. In this configuration, the direction of fluid flow from manifold 48 is noted by arrow 102. As the fluid flows at a relatively high velocity, volumes of the fluid would be captured in calming regions 82 within each protuberance 84 above its respective port 120 and its associated nozzle therein. The fluid would be provided at each port without exposure to high velocity fluid thereby avoiding the potential shearing effect and consequently providing a relatively stable liquid source to each nozzle at about the operating pressure of the liquid-flow system. The available and stable liquid flow at a system pressure would be presented without displacing the numerous nozzles currently used for such systems as the opposed alignment of ports 120 and nozzles would about provide the same number of nozzles. The precise number of nozzle could obviously be increased by providing added ports 120 and nozzles along cylinder 88, which ports are noted in lateral alignment with ports 120 of protuberances 84 in FIG. 12, although such lateral port alignment is not a requisite of the present invention.

Additionally, it is noted that the lateral spacing 142 between adjacent branches 80 in FIG. 10 is significantly greater than the lateral spacing 144 of prior art branches 50 noted in FIG. 7. The increased spacing allows easier maintenance of the top surface area of coil assembly 16 or a media fill. Also, as the number of required branches 80 for each manifold 48 is approximately one-half of the number of branches 50 of the current water spray assemblies 14, it will reduce the number of branches requiring service and it is expected to reduce the cost of branches in each heat exchange unit 11.

While only specific embodiments of the invention have been described and shown, it is apparent that various alterations and modifications can be made therein. It is, therefore, the intention in the appended claims to cover all such modifications and alterations as may fall within the scope of the invention.

We claim:

1. A liquid spray assembly having an upper end, a lower end, a manifold, means in said manifold for receiving a liquid from a source of liquid, and at least one distribution apparatus connected to said manifold, each said liquid distribution apparatus comprising:

an elongate member with a first end, a second end, a central passage and a longitudinal axis;

one of said first ends and second ends being closed;

the other of said first and second ends being open;

at least two protuberances extending from said elongate member and generally normal to said longitudinal axis, said at least two protuberances being approximately parallel to said upper end, said lower end, and each other;

each said protuberance defining a calming region, said calming region open to said central passage;

each said protuberance having at least one port, each said port having a nozzle;

said manifold having at least one aperture for communication of said liquid at a liquid velocity to said elongate member, said elongate member being matable with said aperture, said liquid velocity having a wall shear effect in said central passage;

each said protuberance calming region being positioned above said port and nozzle, thereby reducing said velocity of said liquid from said elongate member and reducing said wall shear effect over said ports for quiescent and stable liquid delivery to said ports and nozzles;

each protuberance having an upper surface and a lower surface;

said protuberance upper surfaces of said elongate member being substantially coplanar;

said protuberance lower surfaces of said elongate member being substantially coplanar;

said plurality of said protuberances arranged along said elongate member between said first end and second end;

said elongate member having a wall;

said plurality of protuberances along said elongate member being arranged in an alternating array with each one of said protuberances extending from said elongate member along alternating sides of said member with said upper and lower protuberance surfaces of said alternating protuberances being substantially coplanar, and said openings to said central passage facing said elongate member wall.

* * * * *